US006675424B2

(12) United States Patent
Smith et al.

(10) Patent No.: US 6,675,424 B2
(45) Date of Patent: Jan. 13, 2004

(54) LITTER VACUUM

(75) Inventors: Wilton E. Smith, Raeford, NC (US); Gary E. Palmer, Buchanan, TN (US); Jesse V. Mondigo, Aurora, IL (US); Timothy A. Strickland, Raeford, NC (US)

(73) Assignee: Minuteman International, Inc., Addison, IL (US)

( * ) Notice: Subject to any disclaimer, the term of this patent is extended or adjusted under 35 U.S.C. 154(b) by 14 days.

(21) Appl. No.: 10/092,152

(22) Filed: Mar. 6, 2002

(65) Prior Publication Data

US 2002/0138939 A1 Oct. 3, 2002

Related U.S. Application Data

(60) Provisional application No. 60/273,977, filed on Mar. 7, 2001.

(51) Int. Cl.[7] ..... E01H 1/05; E01H 1/08

(52) U.S. Cl. ..... 15/87; 15/340.4; 15/346; 15/347; 15/349

(58) Field of Search ..... 15/49.1, 87, 340.4, 15/346, 349, 347

(56) References Cited

U.S. PATENT DOCUMENTS

| | | | | | |
|---|---|---|---|---|---|
| 4,290,820 | A | * | 9/1981 | Swisher et al. | 15/87 |
| 4,335,482 | A | * | 6/1982 | Jones | 15/87 |
| 4,368,554 | A | * | 1/1983 | Mealing et al. | 15/87 |
| 6,052,865 | A | * | 4/2000 | Schwarze et al. | 15/87 |
| 6,070,290 | A | | 6/2000 | Schwarze et al. | 15/340.1 |

* cited by examiner

*Primary Examiner*—Theresa T. Snider
(74) *Attorney, Agent, or Firm*—Emrich & Dithmar

(57) ABSTRACT

A mobile litter pickup vehicle has a pair of forward corner brushes independently mounted on articulated arms so that the brushes may be moved in the event an obstacle is encountered to avoid damage to the brushes or to the object. An air recirculating system is employed for prolonging the life of the final outlet filter, and an impermeable trash bag may be used for disposing of the contents of a primary scrim collection bag.

16 Claims, 19 Drawing Sheets

LITTER VACUUM

RELATED APPLICATION

This application claims benefit under 35 U.S.C. 120 of co-pending provisional application Ser. No. 60/273,977 filed Mar. 7, 2001 for LITTER VACUUM.

FIELD OF THE INVENTION

The present invention relates to motor-driven or riding vacuum machines of the type used to clean litter, debris and dirt or sand from public parkways, streets, sidewalks, and large open areas such as parking lots, parks, and the like. Vehicles of this type are designed to recover a large range of litter, including dust, dirt, sand and debris, bottles, cans, clippings, hedge trimmings, and the like.

SUMMARY OF THE INVENTION

The present invention relates to improvements in litter vacuums. A first improvement is directed to the suspension of the vacuum housing or "shoe" and the mounting of the forward or "corner" sweeper brushes. An actuator such as an hydraulic cylinder operated by the operator rotates a crank which lifts the vacuum shoe. A four-bar or parallelogram linkage suspends the vacuum shoe to the chassis or frame of the vehicle so that it may be moved between a lowered use position and a raised transport position. Moreover, the forward portion of the vacuum housing is mounted by means of linkages having slots or "lost motion" links so that when the vacuum housing is in the lowered or use position and the housing rests on rollers or wheels to provide the proper operating height, the vacuum housing may ride over obstacles or bumps independently of the corner sweeper brushes. At the same time, if the operator sees an unusually large object in the way, such as a quart or liter plastic bottle, he may actuate a cable to raise the vacuum shoe to permit it to accommodate the large object, and suction the object up. Again, this raising of the vacuum shoe is independent of the sweeper brushes.

The sweeper brushes are mounted to the same hydraulic lift mechanism which raises and lowers the vacuum shoe. However, the brushes may be latched in the raised or storage position to permit the vacuum shoe to be used on gross or outdoor carpeting. The sweeper brushes are mounted on linkages which permit an articulated motion of the brushes. Each brush is mounted similarly to the other so that only one need be described. The brushes operate independently of each other. If a corner brush encounters an object head-on in the sweeping position, it is permitted, against a spring bias, to rotate outwardly and rearwardly, about a vertical pivot located inwardly and rearwardly of the vertical center of the brush. This permits the brush to move rearwardly of the forward-moving machine without damage. It also increases the moment arm by which a second articulated arm on which the brush is mounted may move inwardly toward the center of the machine, folding the brush beneath the chassis or frame in cooperation with the first articulating link and protecting the brush against further damage.

Thus, the shoe and brushes may be raised for transport or storage or lowered for use while the brushes may be latched in the storage position as the vacuum shoe is used for suctioning debris, and the shoe may be independently raised for larger objects.

The vacuum shoe is equipped with a door mounted to close or adjust the inlet opening by a cable controlled by the operator. The door is provided with a flexible lower strip to adjust to the surface being cleaned. By closing the inlet opening, the operator may control the velocity of the air entering the front of the vacuum shoe and directing the incoming air to pass close to the surface being cleaned. This section entrains dust, debris and smaller particles such as sand into the suction air stream from which the debris is filtered and collected.

Another improvement incorporates a scrim bag to collect and filter the debris in a hopper which may be pivoted to dump the contents. This improvement renders unnecessary a supplemental refuse container. The scrim bag is disposable and coupled to an inlet from the blower to receive the debris. Air passing through the scrim bag and not passing through the main filter is recirculated to the vacuum shoe. A disposing plastic bag is mounted in a flat configuration adjacent a rear hopper door. When it is desired to dispose of the material collected in the scrim bag, the hopper door is unlatched, the hopper is rotated to the dump position, and the scrim bag and its contents falls into the plastic trash bag which is then secured so the contents may be disposed of.

As an alternative, when the debris is primarily larger material such as lawn clippings or trimmings or cups and plates, a scrim bag may be used to collect debris and the scrim bag may be emptied directly into a refuse container.

The present invention also includes provisions for a recirculation aperture in the hopper at a location between the solid walls of the hopper and the scrim bag or other filter bag in the hopper. Refuse entrained in the suction air is introduced through the hopper into a pre-filter bag. Air (and some smaller particles) passes through the filter bag and exits the hopper, through a final filter which extracts "fines" or dust from the air before exhausting the air into the atmosphere. The debris, once it enters the filter bag, tends to settle down because the velocity of the suction air decreases in the larger volume of the hopper. By placing the inlet of a recirculation conduit between the wall of the hopper yet outside the filter bag, the recirculating aperture acts as a differential pressure regulator responsive to the pressure across the final filter. If the final filter becomes clogged, the pressure across it increases, and a greater amount of air is then recirculated to the vacuum housing. This extends the useful time of the final filter before replacement or cleaning the final filter.

Other features and advantages of the present invention will be apparent to persons skilled in the art from the following description of the illustrated embodiment accompanied by the attached drawing whether identical reference numerals will refer to like parts in the various views.

DETAILED DESCRIPTION OF THE ILLUSTRATED EMBODIMENT

Figure 1:
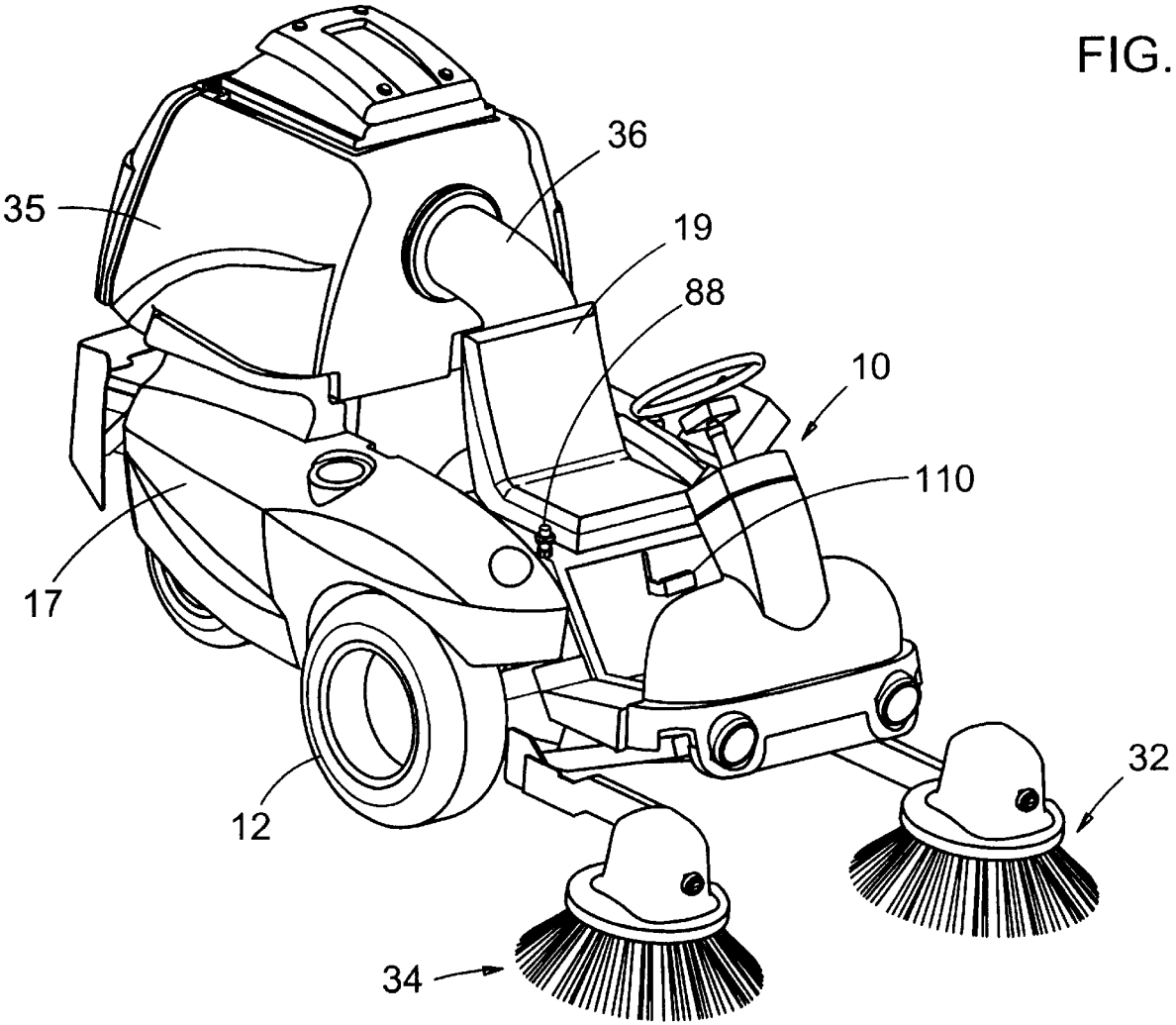
FIG. 1 is an upper right frontal perspective view of a litter vacuum machine incorporating the present invention.

Referring first to FIGS. 1–4, there is shown a litter vacuum machine incorporating the present invention. The machine is generally designated by reference numeral 10 in the drawing, and it includes a frame or chassis, a pair of front wheels 12, 13 carried by the frame, a rear steerable wheel 15 which is driven, conventionally, by an hydraulic motor powered by a diesel engine carried by the frame and housed within the molded housing or outer casing 17. Mounted above the forward portion of the outer casing 17 is a driver's seat 19 in front of which is a steering wheel 20 mounted in a steering pedestal 24 located at the forward end of the frame of the vehicle.

Figure 2:
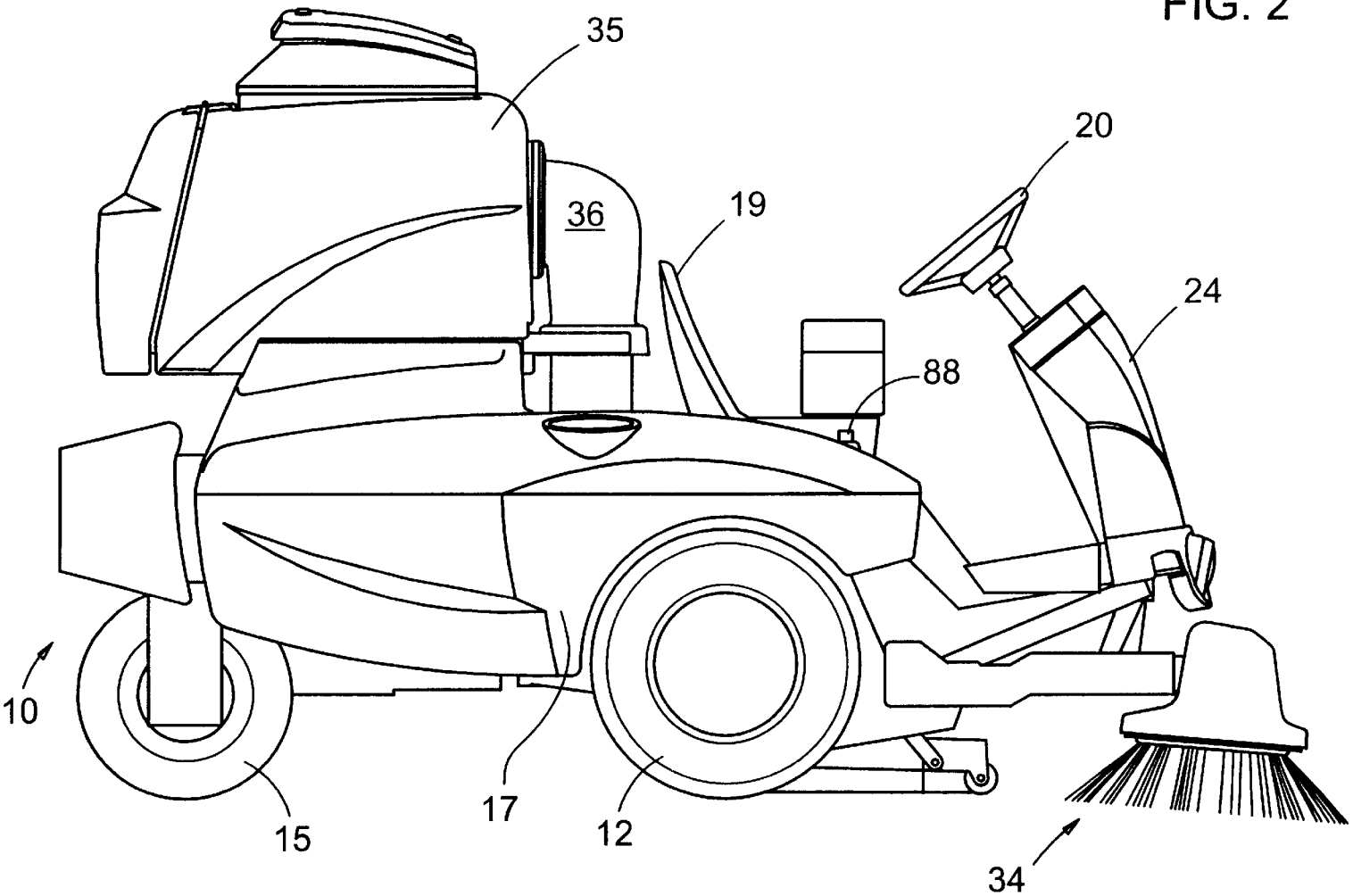
FIG. 2 is a right side view of the machine.
Figure 3:
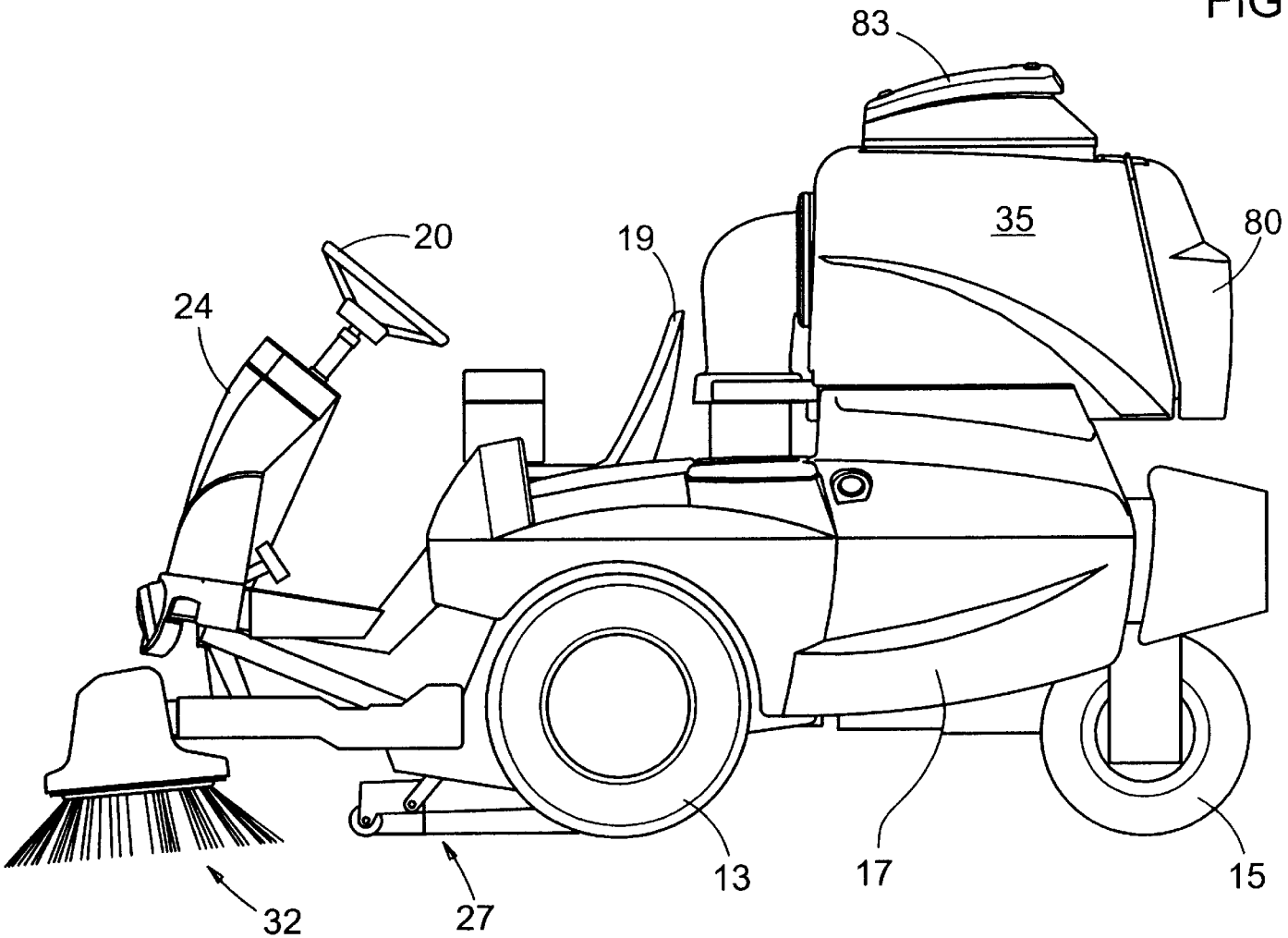
FIG. 3 is a left side view of the machine of FIG. 1.
Figure 4:
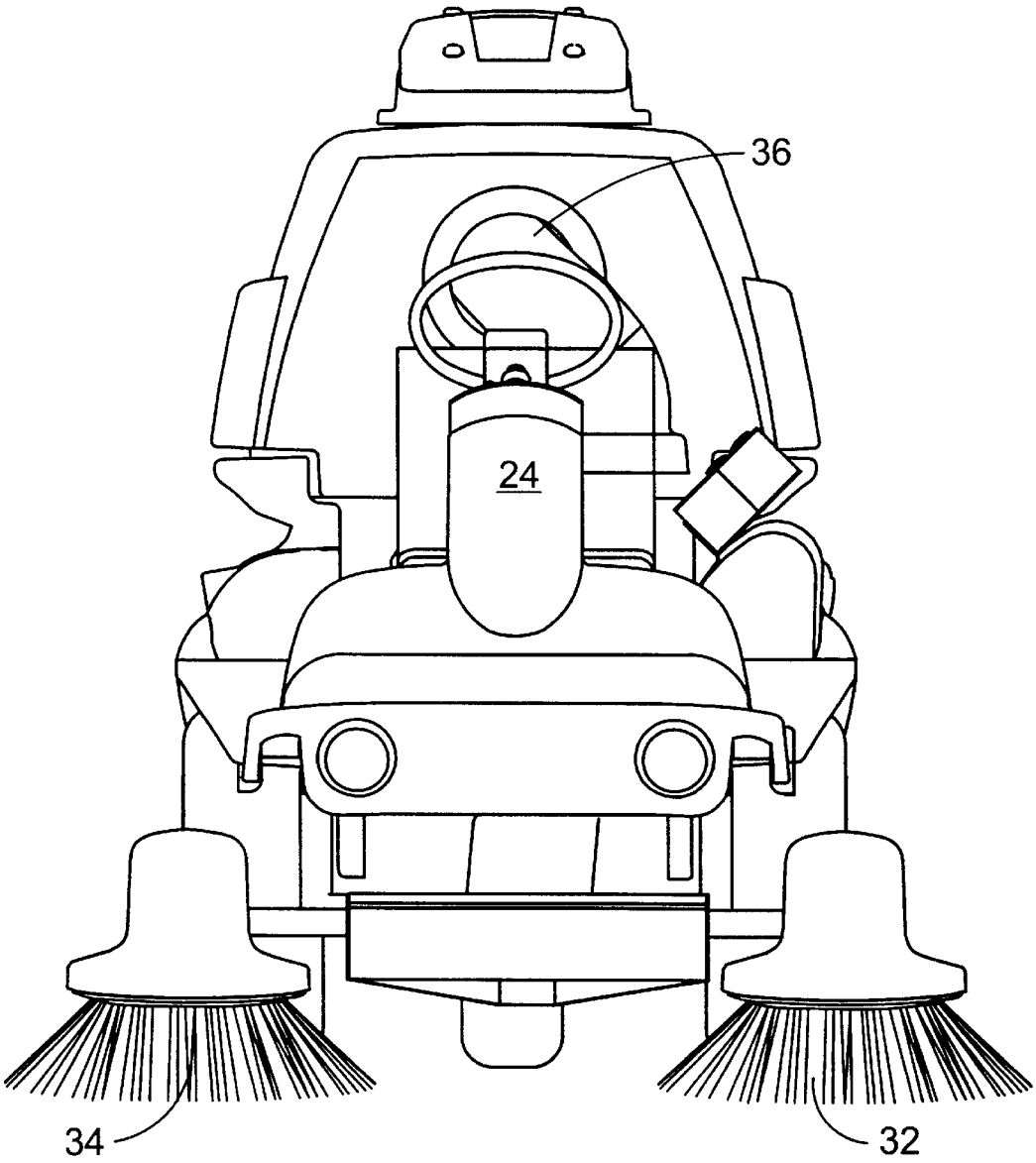
FIG. 4 is a front view of the machine of FIG. 1.

It will be observed from FIGS. 2 and 3 that the operator's seat 19 is located between and above the forward wheels 12, 13. The drive, steering linkage and frame are conventional and need not be described in further detail. Rather, the invention is related to the mounting of a vacuum (i.e., suction) housing or "shoe" 27 beneath the forward portion of the frame, the suspension of left and right sweeper brushes generally designated 32 and 34, the emptying of the debris hopper 35 and the recirculation of suction air from the hopper to the vacuum shoe. The hopper 35 is mounted above the rear portion of the casing 17 behind the driver so as to avoid obstructing his/her view during normal operation which is in a forward direction, and leaving unobstructed lateral views, as can be seen from FIGS. 2 and 3.

In operation, the motor of the machine, in addition to driving the rear wheel 15, drives a conventional suction fan or blower housed within the molded casing 17 and beneath the driver's seat 19. The input of the blower is coupled, as will be further described, by means of a large conduit to the vacuum housing 27. In the operating position, the vacuum housing may ride along the surface to be cleaned or slightly elevated, at the option of the operator. The suction or vacuum air, as will be further described, picks up the debris and dust, which passes through the blower and is further crushed or broken, and then delivered by means of a conduit 36 to the hopper 35 (FIG. 1).

Figure 5:
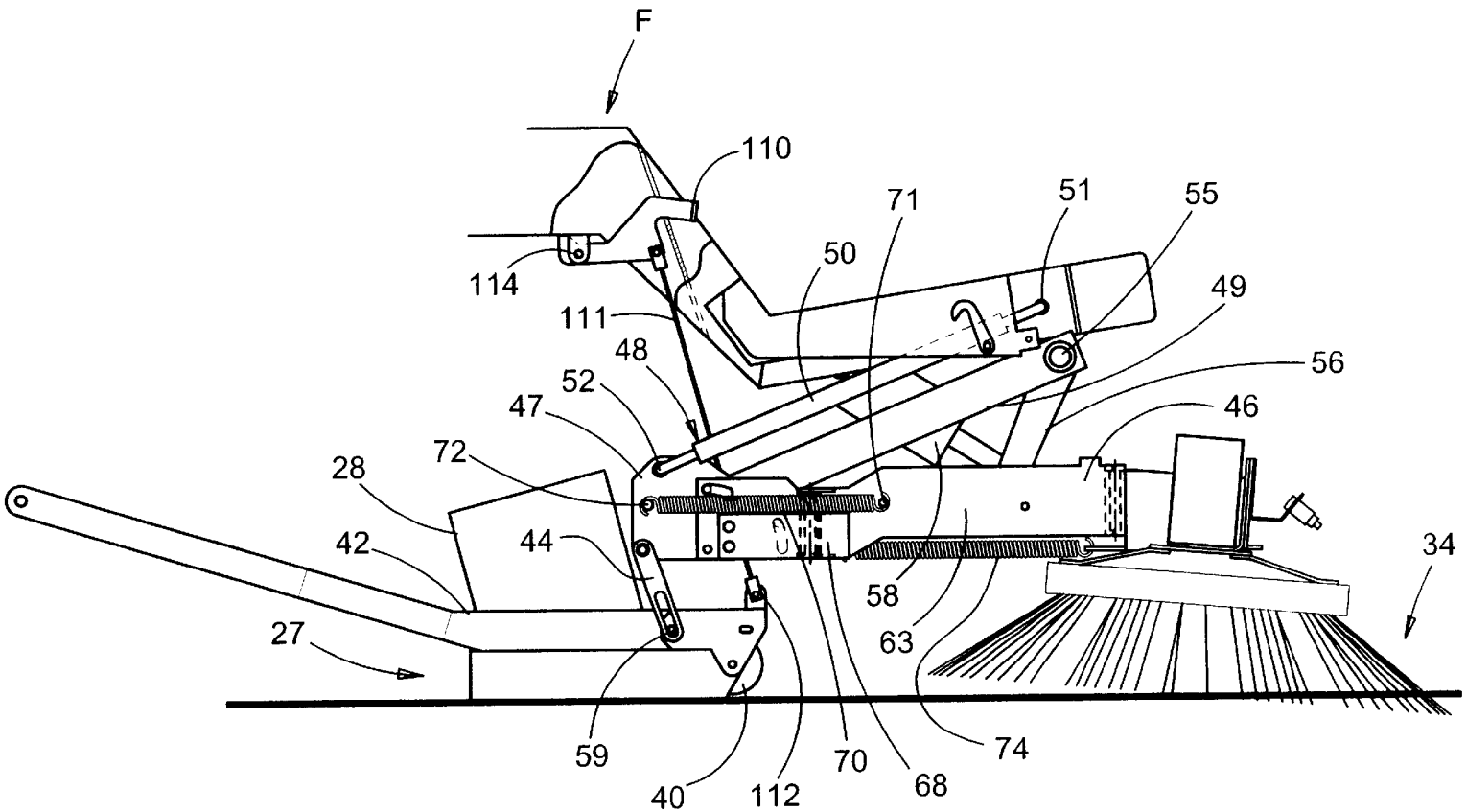
FIG. 5 is a fragmentary right side view of the suspension system for the vacuum shoe and the sweeper brushes lowered to the use position.

Turning now to FIG. 5, the vacuum shoe 27 includes a tubular coupling 28 to which is mounted a flexible suction hose 29 (FIG. 8) connected to the inlet of the blower. The coupling 28 is mounted to the top plate 38 (FIG. 8). A smaller coupling 30 is also mounted to the top plate 38 and is coupled to a flexible hose 31 for delivering recirculated air to the shoe 27. FIGS. 5–8 illustrate the improved suspension for the vacuum housing 27 and the forward left and right sweeper brushes 32, 34 (see FIGS. 1, 2). The mounting of the brushes 32, 34 is the same, except that the mount for the left brush is the mirror image of the mount for the right brush, as will be understood. Thus, the mounting for only one of the brushes need be described in further detail for an understanding of the improvements. The operation of each articulated suspension arm for the burshes is independent of the other.

As can be seen from FIG. 8, the forward portion (i.e., inlet opening) of the vacuum shoe 27 is provided with an adjustable door or flap designated at 39, to permit the shoe 27 to receive debris. The forward portion of the housing, at the left and right sides, is provided with rollers or wheels 40 for engaging the ground when the vacuum housing is lowered to the use position, as seen in FIG. 5 (and FIG. 7A) for suctioning up the debris within the vacuum shoe 27.

A pair of arms 42 (FIG. 6) are fixed, as by bolting, to the vacuum shoe 27. The rear portions of the arms 42 are connected by means of a transverse rod 43 which, in turn, is rotatably carried by the frame of the machine so that the arms 42 may be rotated between the lowered or use position of FIG. 5 and the raised or transport position of FIG. 6 by an actuator such as hydraulic cylinder (FIG. 7). In addition, the operator may raise the vacuum show 27 to suction larger objects while the actuator is in the use position with the brushes sweeping the ground, as seen in FIG. 7. This is accomplished by a pivot handle 110 and cable 111 connected between the handle 110 and the front of the vacuum shoe at 112. The handle 110 is accessible from the operator's station and pivotally mounted to the frame at 114 (FIG. 5). The front of the vacuum housing 27 is mounted by means of left and right slotted links 44 (the left one being shown in FIG. 14 and the right slotted link 44 being shown in FIG. 5) pivotally mounted to respective ones of the forwardly extending arms support arms 42 of the pivoted show support. Referring to FIGS. 5–7A, the upper ends of the slotted links are pivotally connected to left and right side lift plates 47. The lift plates 47, in turn, are mounted to and supported by an actuator mechanism which includes left and right four-bar linkages 48, as will be described presently. The lift plates also support left and right articulated arms 46 which, in turn, carry the brushes 32, 34. These structures, including the slotted links, lift plates, articulated arms and four-bar actuating linkages are similar on left and right sides.

The four-bar linkage 48, as seen in FIGS. 5 and 7, includes a lower link 49 (which acts as a crank arm) and an upper link 50. A portion of the frame of the machine, in the form of two downwardly and forwardly extending support struts, is designated F in FIGS. 5 and 7. The forward portion of the upper link 50 is pivotally connected at its forward end, to the frame F at 51 (see also FIGS. 16–17), and its rear end is pivotally connected at 52 to the right lift plate 47. The forward end of the lower parallel link or crank 49 is fixed to a rock shaft 55 (FIG. 14) which is journaled in forward extensions of the frame F. Downwardly extending tabs 56 are welded to the rock shaft 55. The rear ends of the parallel links 49, 50 are pivotally connected to associated lift plates 47.

Figure 14:
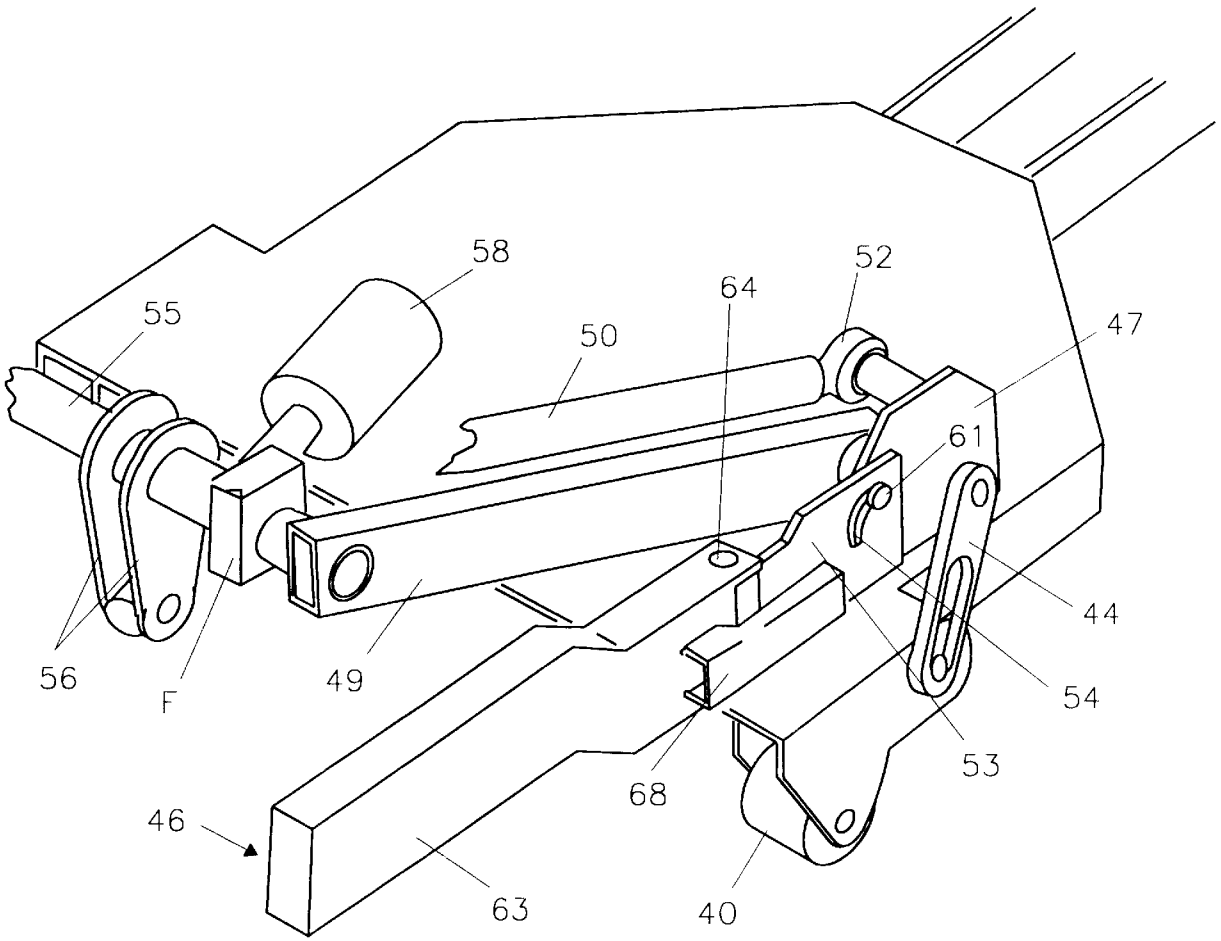
FIG. 14 is a left upper frontal perspective view of the vacuum shoe illustrating the left portion of the mounting of the brush and the left portion of the lift mechanism.

Turning now to FIG. 14, an hydraulic cylinder 58 has its rod end pinned to the tabs 56 welded to the rock shaft 55, and its cylinder end pinned to the frame F. Thus, the lower links 49 of the parallel linkages 48 are arms of a crank actuated by the cylinder 58. When the cylinder 58 is retracted the rock shaft 55 rotates clockwise as viewed from the right (FIG. 5) relative to the frame F of the machine, thus raising the lift plates 47 which carry the front end of the vacuum shoe via slotted links 44 and the articulated arms 46, thereby raising both the vacuum shoe 27 and the brushes 32, 34 to the storage or transport position seen in FIG. 6. The parallel linkage 48 maintains the articulated arms 46 in a generally horizontal disposition for all elevations of the articulated links 46, as will be seen by comparing FIG. 5 (the lowered or use position) and 6 (stored position) except when the articulated arms are latched in the raised position, as will be described.

Figure 6:
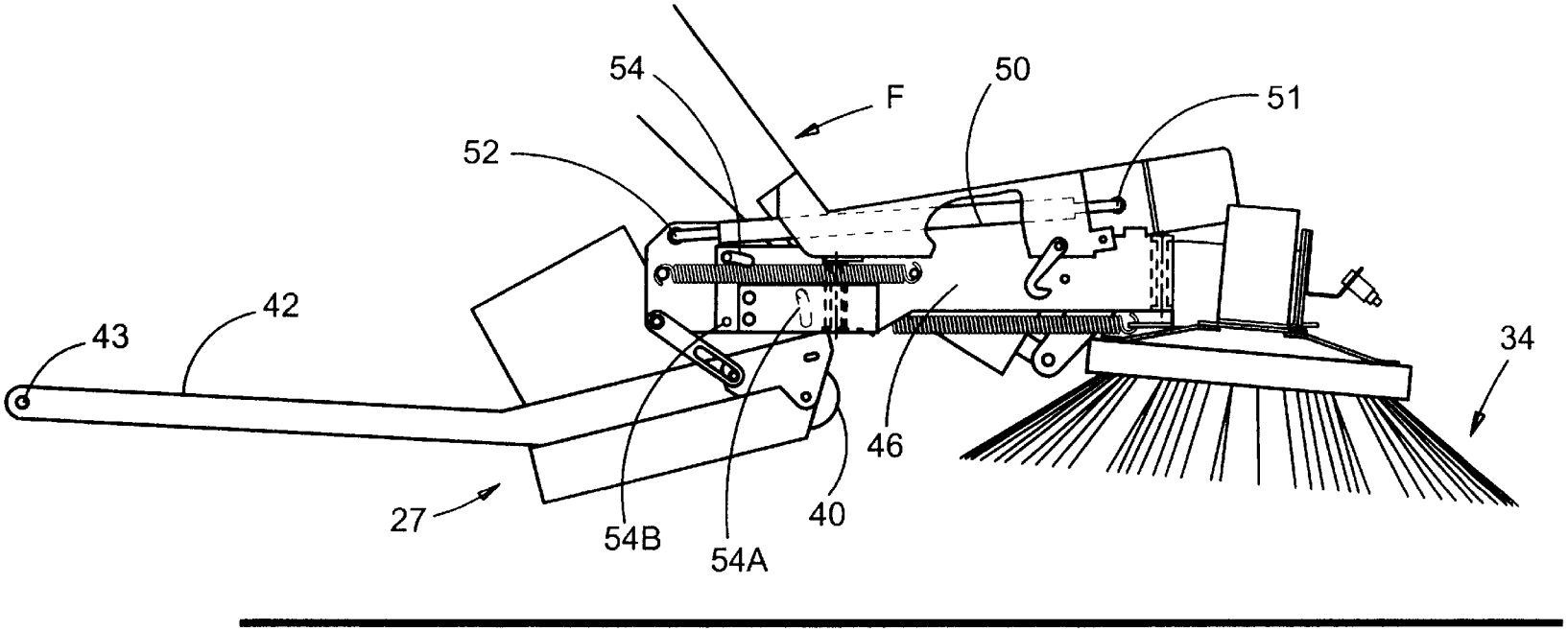
FIG. 6 is a view similar to FIG. 5 with the vacuum shoe and sweeper brushes raised for storage.
Figure 7:
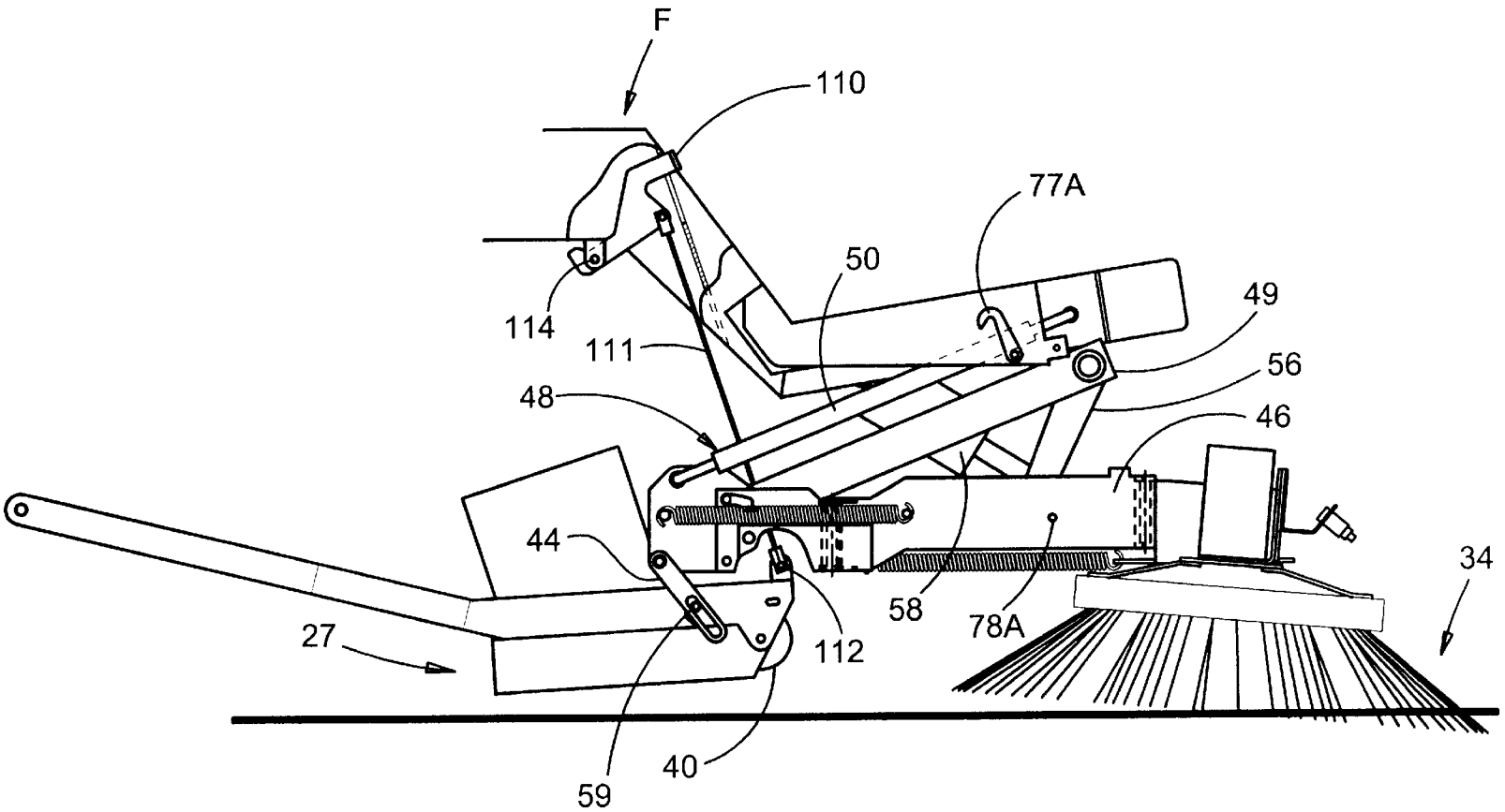
FIG. 7 is a view similar to FIG. 5 with the vacuum shoe raised to accommodate larger objects in perspective, of the suspension system for the vacuum housing.
Figure 7A:
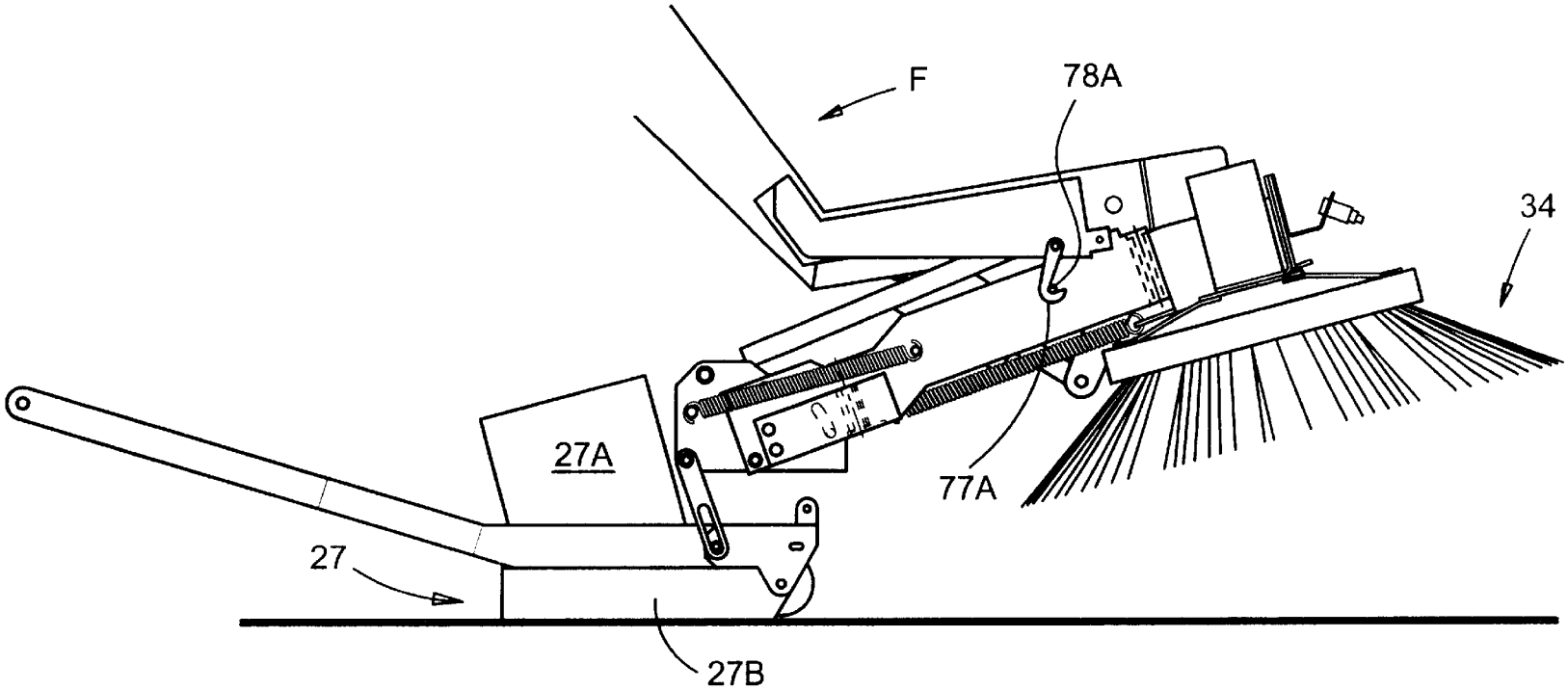
FIG. 7A is a view similar to the FIG. 5 with the brushes latched in the raised position.
Figure 8:
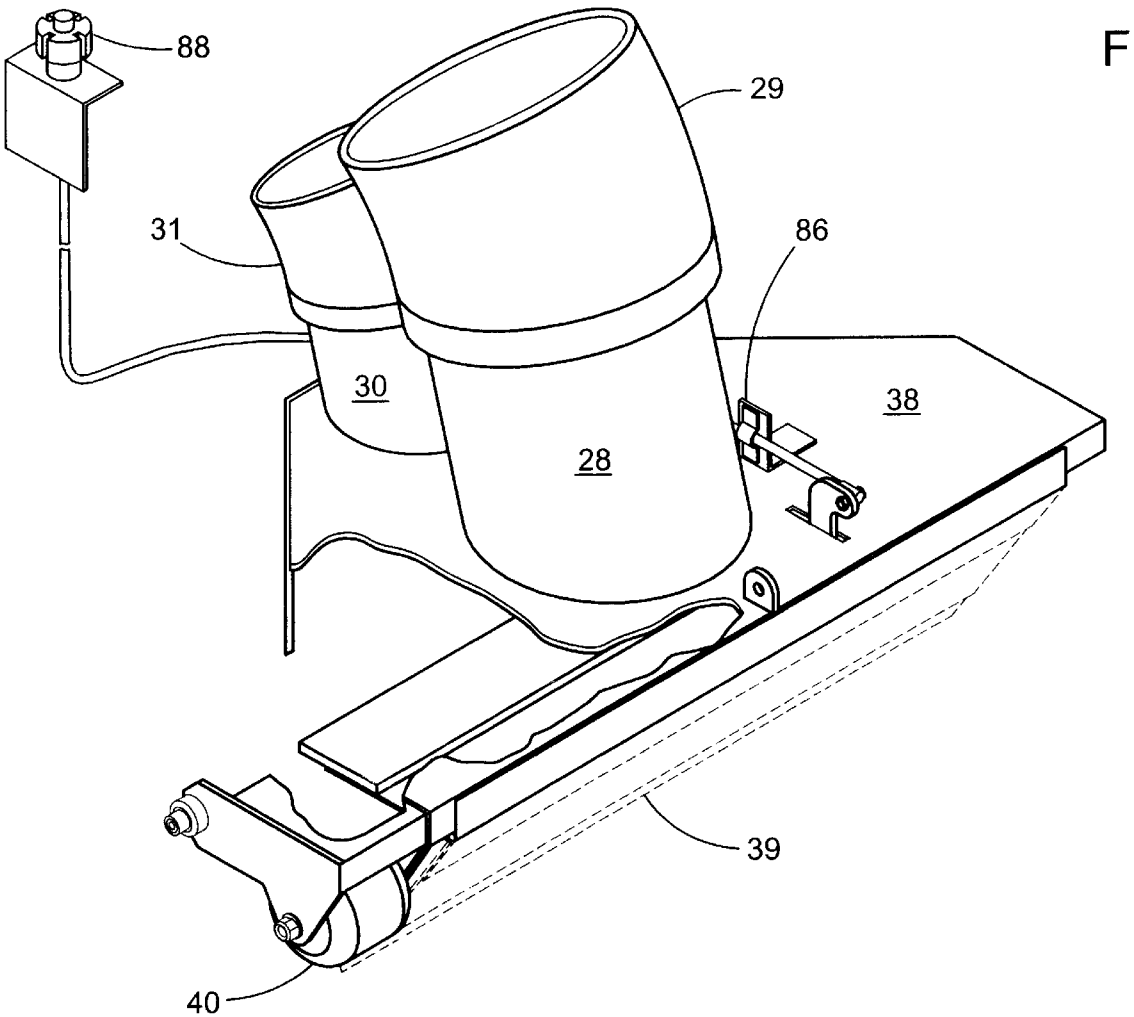
FIG. 8 is a right upper frontal perspective view of the vacuum shoe partially cut away to show the adjustable door.

As indicated in FIGS. 5 and 6, the slotted links 44 which suspend the forward portion of the vacuum housing 27 from the rear of the lift plates 47, receive bolts or pins, such as the one designated 59 in FIG. 7, secured to the side of the vacuum housing 27. The pins 59 are free to ride in the slots so that the forward portion of the vacuum housing 27 may raise as the wheels 40 encounter a bump or other obstruction without affecting the setting of the rotating sweeper brushes 32, 34.

Turning now to the articulated arms 46, reference is made to FIGS. 5, 6, 7 and 7A. As mentioned, FIGS. 5 and 6 illustrate the right side articulating arm 46, and the left articulating arm (shown in FIGS. 10–13, and 14) is substantially the same as the right arm except in mirror image.

Turning first to FIG. 14, the articulating arm 46 is pivotally mounted to lift plate 47 by means of a plate 53 having two curved slots 54 and 54A (FIG. 6) and a pivot 64 (FIG. 14). Slot 54 receives a pin 61 fixed to the lift plate 47. A first link 63 is pivotally mounted to the plate 53 for rotation about a vertical pivot axis as at 64. A forward link or arm 65 (FIG. 15) is mounted for rotation about a vertical pivot 66 (FIG. 15) to the forward portion of the first link 63. The right side brush assembly 34 is mounted to the forward link 65.

Figure 15:
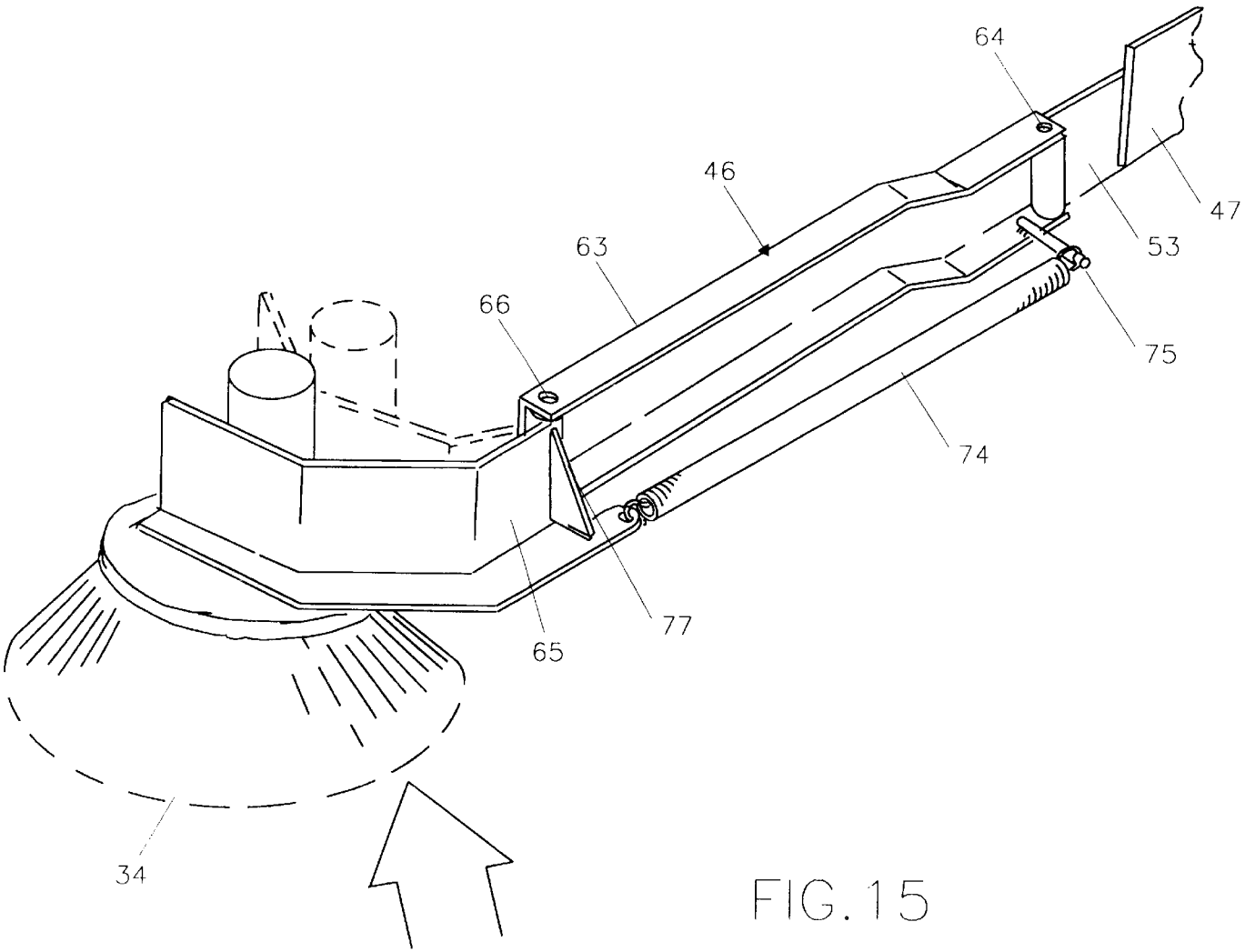
FIG. 15 is a partial view, in perspective, of the articulate arm for the right corner brush.

Turning now to FIG. 15, the right side link or arm 63 may rotate in a counterclockwise direction, which viewed from above, from its normal, fore-to-aft direction (the use position) seen in solid line in FIG. 15. A stop member 68 (FIG. 14) prevents the inner link 63 from rotating outwardly beyond the fore-to-aft position parallel to the direction of travel of the machine. In other words, the first or inner links of the articulating linkages are permitted to rotate laterally inwardly toward the center of the machine, thereby moving the associated brush assemblies as diagrammatically illustrated in FIG. 11 for the left brush, inwardly. A first extension spring 70 (FIG. 5) is connected at it forward end to the outboard side of the link 63 by means of a peg 71, and its rear end is connected by means of a peg 72 to the lift plate 47. The spring 70 is pre-loaded under tension, so that the rear arm 63 is biased outwardly toward the use position shown in FIG. 10, limited by the stop 68 (FIG. 5). However, as will be explained, a laterally inward force caused by an impact may cause the arm 63 to rotate inwardly.

Similarly, a second extension spring seen in FIGS. 5 and 15 and designated 74 is connected in tension between a pin 75 at the rear of the link 63 and forward link 65, biasing the forward link 65 to the position shown in solid line in FIG. 15 which is the forward limit or normal use position. An impact in the direction of the arrow in FIG. 15 would cause the arm 65 to rotate clockwise as viewed from the top (for the right linkage seen in FIG. 15), and thereby causing the brush assembly 34 to move rearwardly to the position shown in dashed line. Again, the link 65 (which is formed generally forwardly and thence outwardly of the normal position of the first link 63 as seen in FIG. 15) is limited at the forwardmost position by a stop 77 engaging the link 63 so that it may not rotate further inwardly toward the center of the machine.

Figure 10:
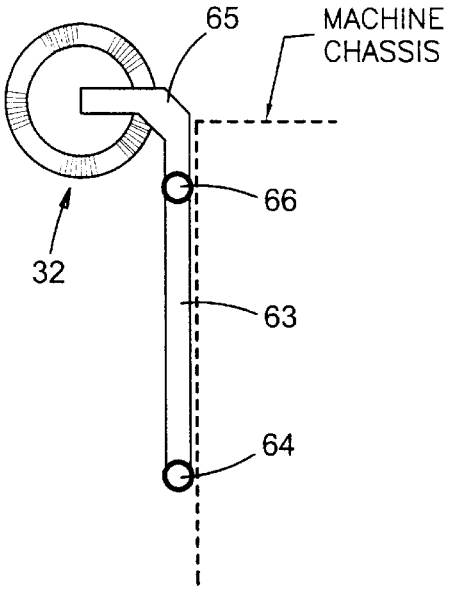
FIGS. 10, 11, 12 and 13 are diagrammatic top views showing the operation of the articulated linkage for the sweeper brushes.
Figure 11:
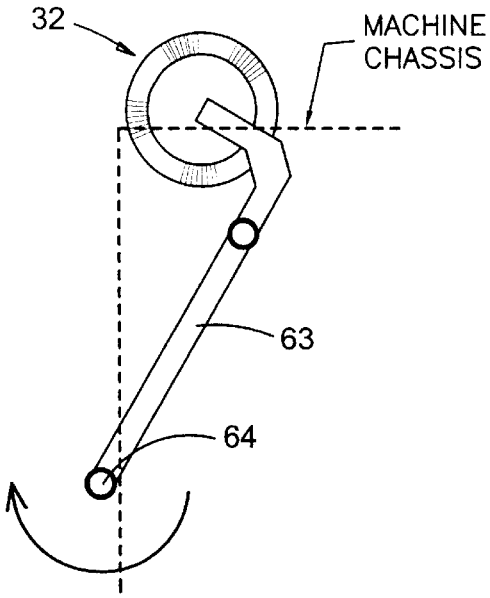

Turning now to FIGS. 10–13, the range of motions for the articulating linkages supporting the brushes is illustrated for the left brush 32. As seen in FIG. 10, the articulating linkage is in the normal position, the outline of the machine chassis or frame being schematically illustrated by the solid chain line. In the normal use position of FIG. 10, the first or rear articulating link 63 extends parallel to the direction of travel, and the forward, angled link 65 suspends the left brush (and its associated housing and drive motor) in the normal, desired use position, leaving the brush 32 capable of cleaning corners to the left of the machine or beneath overhangs, or over normal, flat terrain. In the event of a side impact, caused either by movement of an object from left to right, engaging the brush 32 or its housing, or by steering the machine too close to a wall or other obstruction on the left side of the machine, the articulating linkage as a whole is permitted to rotate clockwise about the rear pivot 64, moving the brush 32 inwardly toward the center of the chassis and reducing damage to the brush assembly.

In the case of a forward impact (i.e., directly from the front), it will be observed that the link 63 is located in a fore-to-aft direction and has little or no freedom of movement in the case of a direct, head-on collision. However, the angled forward link 65 extends laterally of a link 63 and is thus permitted to move against the bias of spring 74 (not seen in the diagrammatic showings of FIGS. 10–13) and to rotate counterclockwise about the forward pivot 66 to a position rearward of the forward section of the machine frame, as illustrated in the diagrammatic showing of FIG. 12.

Figure 12:
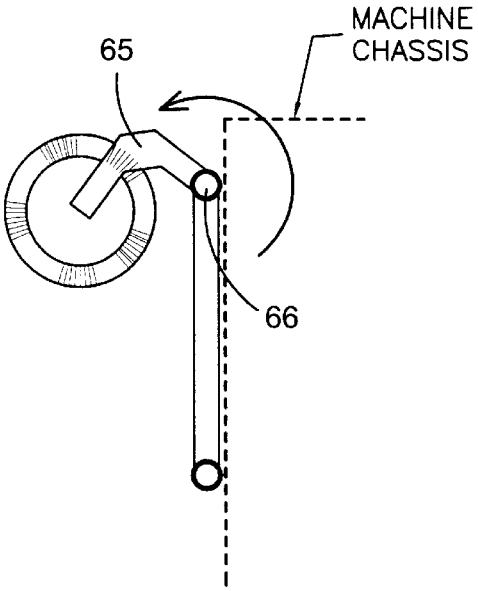
Figure 13:
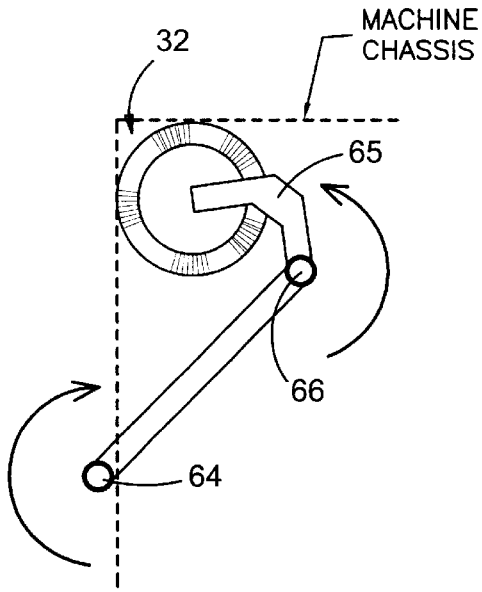

In the case where the machine is turning toward the right, or encounters a head-on collision at a higher speed and it is therefore more difficult to alleviate by the operator, it will be observed from FIG. 12 that the moment arm exerted by the angled link 65 about the rear pivot 64 has increased relative to the moment arm at the normal position seen in FIG. 10. Thus, there is more leverage (counterbalancing the force of spring 70) to rotate the rear link 63 clockwise to the protected position of FIG. 13. In this case which is illustrated by a right turn which is improperly executed, the rear link 63 pivots inwardly about the rear pivot 64, and the forward, angled link 65 rotates counterclockwise about the forward pivot 66. The combinations of the two motions bring the brush 32 to nest within the more protective confines of the machine frame, thereby reducing damage to the brush assembly 32 and the articulated linkages.

There are times when it is desirable for the operator to manually raise the forward portion of the vacuum housing, for example, in the event that a large container is encountered, such as a quart-size beverage container. To accommodate this, the previously described pivoted lever 110 adjacent the operator's position, and the wire cable 111 (FIG. 7) are used to manually raise the vacuum shoe 27 as seen in FIG. 7. The lever 110 enables the operator, without substantially reducing speed, to expand the inlet opening of the vacuum housing to receive such larger objects without interfering substantially with the operation of the machine and the efficient pick-up of trash and debris.

Turning now to FIG. 7, on each side of the frame F there is a latch designated 77A which is pivotally mounted to the frame. A pin 78A is mounted to the inner link 63 in a position such that the operator may manually raise the side broom 34 and its associated articulated linkage to the position shown in FIG. 7A, and the latch 77A rotated to engage and secure to the pin 78A, thereby elevating the brush 34 to the raised position seen in FIG. 7A while permitting the vacuum shoe 27 to remain in the use position. Such a position is useful for suctioning debris from lawns or for suctioning trimmings adjacent hedges or the like. The vacuum shoe 27 includes an upper metal housing 27A mounted to the lift arms 42, and a lower flexible skirt 27B depending from the housing 27A; the skirt 27B may be made of polyurethane.

Figure 9:
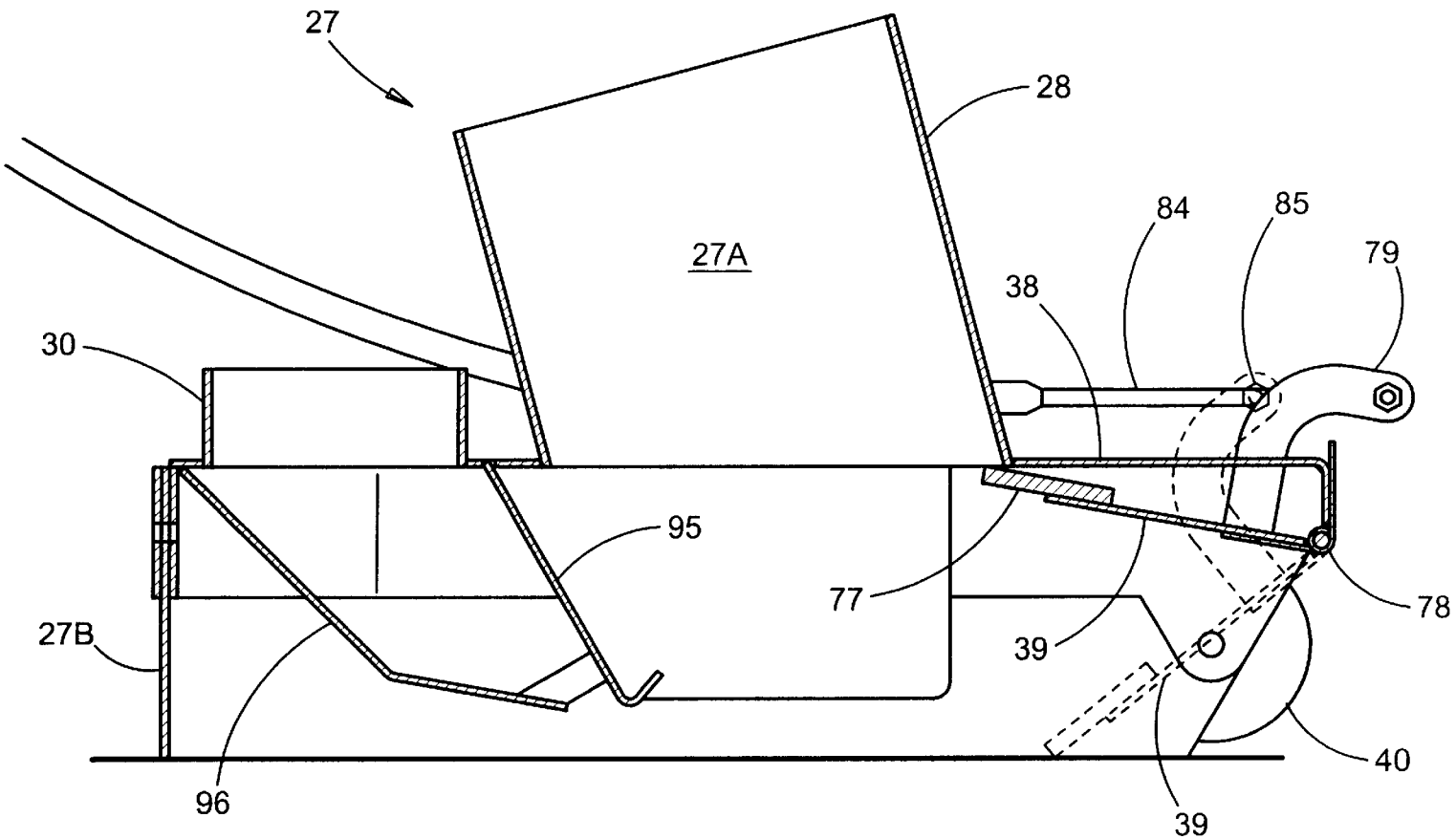
FIG. 9 is a vertical cross section view of the vacuum shoe taken from the right side.

Turning now to FIGS. 8 and 9, the vacuum shoe 27 is seen in more detail. The flap or door 39 having its lower edge provided with a flexible strip 77 of a material such as vinyl or rubber is pivotally mounted at 78 to the forward wall of the housing of the vacuum shoe 27. A curved link 79 is fixed to the flap 39 and extends upwardly through the top wall 38 of the housing of the vacuum shoe 27, as best seen in FIG. 8. A cable 84 is pivotally connected at 85 to the curved link 79. The cable 84 is part of a cable assembly, the sheaf of which is mounted to the top wall 38 of the vacuum shoe 27 by means of a bracket and clamp generally designated 86. The remote end of the cable assembly is carried by the frame of the machine adjacent the operator's station, and the cable may be extended or retracted by means of a knob 88, seen in FIGS. 1 and 8, adjacent the operator's position. When the cable 84 is extended by the operator, the link 75 is forced to the forward position shown in solid line in FIG. 9, thereby raising the flap 39 to the position shown in solid line and opening the inlet of the vacuum shoe to its maximum position. By moving the cable 84 rearwardly, the operator is able to lower the flap 39 to any desired position, the lower limit being shown in FIG. 9 with the flexible strip 77 engaging the surface being treated. As the inlet opening is adjusted to a smaller size, that is, closed by lowering the flap 39 to the position shown in dash line in FIG. 9, the velocity of the air suction entering the vacuum shoe is increased. Moreover, the air is routed through a location adjacent the surface being treated or cleaned. The higher velocity and the location of the inlet air stream agitates dust and small debris which is then entrained in the suction air and routed through the blower and into the collection bag within the hopper 35, as will be described below.

The top of the vacuum shoe is provided with a first coupling member 28 which is connected to a flexible hose, the other end of which is connected to the inlet of the blower. The vacuum shoe is also provided with a smaller coupling member 30 which receives a flexible conduit for recirculating air, as will be described further below. A forward baffle 95 routes the suction air drawn through the inlet opening of the vacuum shoe directly to the coupling member 28 which communicates with the inlet of the blower. Baffle 96 routes the recirculated air from the coupling member 30 forwardly to the rear portion of the baffle 95 and thence upwardly to be recirculated through the coupling member 28.

Figure 16:
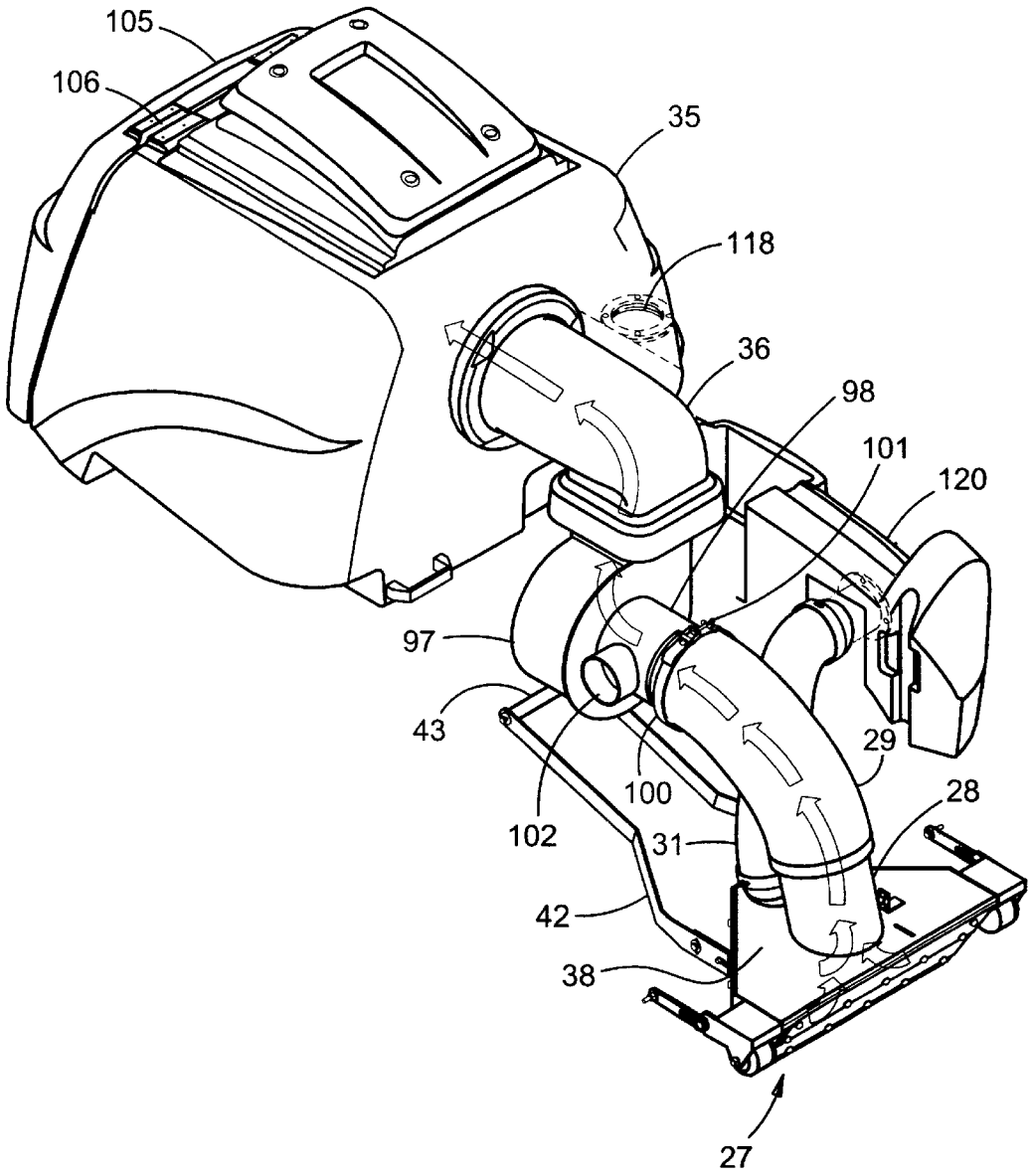
FIG. 16 is an upper right frontal perspective view of the vacuum shoe, hopper, blower and portion of the machine exterior housing illustrating the air intake path.
Figure 17:
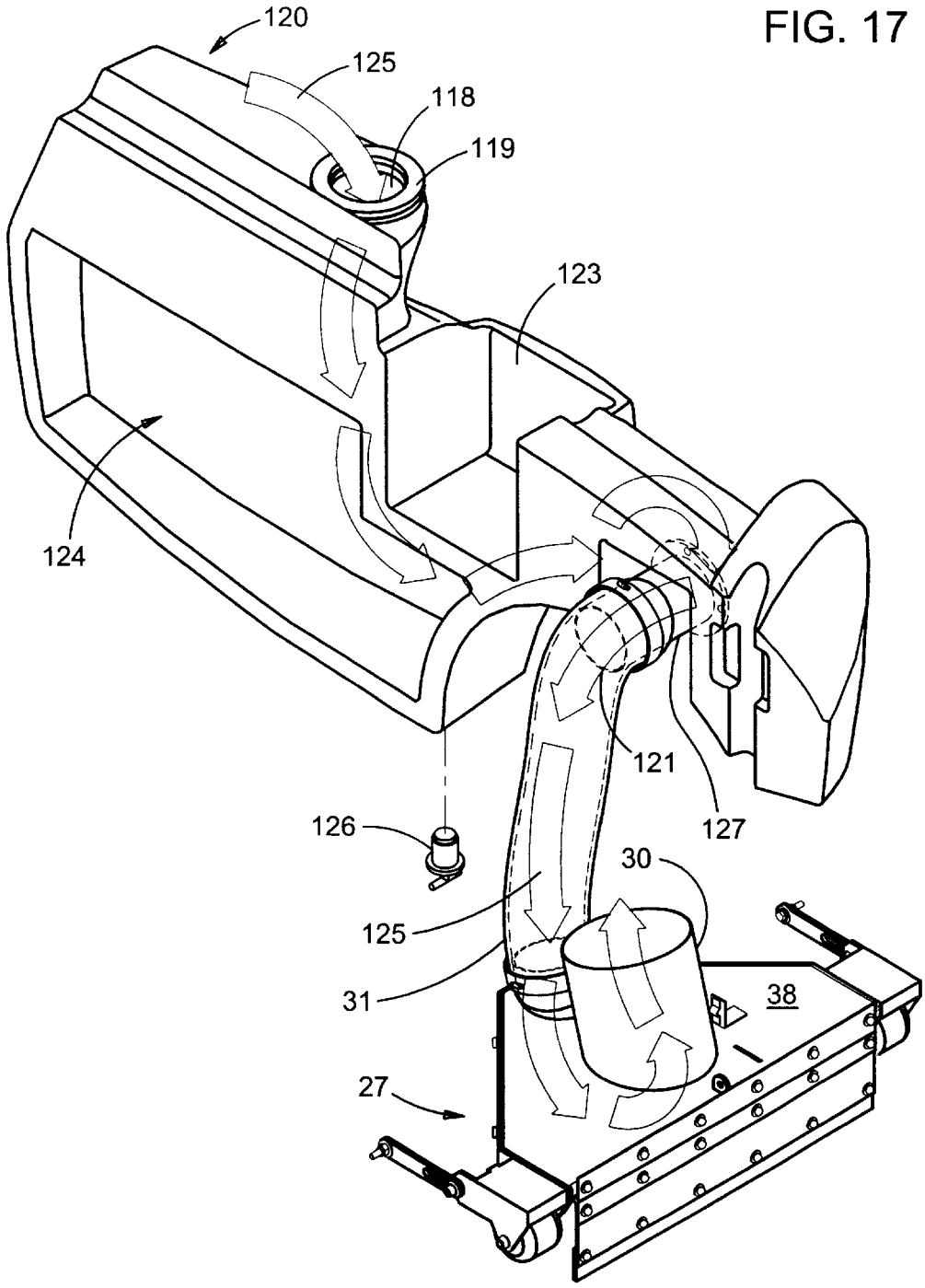
FIG. 17 is a view similar to FIG. 16 omitting the blower and hopper and some of the intake recirculation conduit to better illustrate the flow of recirculating air from the hopper back to the vacuum shoe.

Referring now to FIGS. 16 and 17, the air recirculation system for the litter pickup machine will be described. As described in connection with FIG. 8, suction air is routed from the vacuum shoe 27 through a connecting coupling 28 and a flexible conduit 29 to a blower 97.

The outlet end of the flexible conduit 29 is connected to a tubular inlet conduit 98 by means of a hose clamp 100 having an over-center latch 101. Thus, by a simple unlatching action, the outlet end of the conduit 29 may be released from the inlet section 98 to the blower 97 for inspection or removing debris. The inlet conduit 98 is also provided with a side inlet section 102 which is adapted to receive a flexible conduit (see 104 in FIGS. 18, 19) which may be used for a manual suction tool adapted to clean places which cannot be reached by the vehicle, such as under benches or other seating. A conventional shutter plate may be used to shut off suction from the manual tool when it is not in use, and the conduit may be wrapped around the rear of the vehicle, beneath the level of the hopper, for storage when not in use, all of which features are known in the art, and need not be described for detail.

The discharge end of the blower 97 is coupled to a conduit 36 in the form of an elbow, the downstream end of which is bolted to the front wall of the hopper 35 so that the debris is delivered into the interior of the hopper directly.

Figure 18:
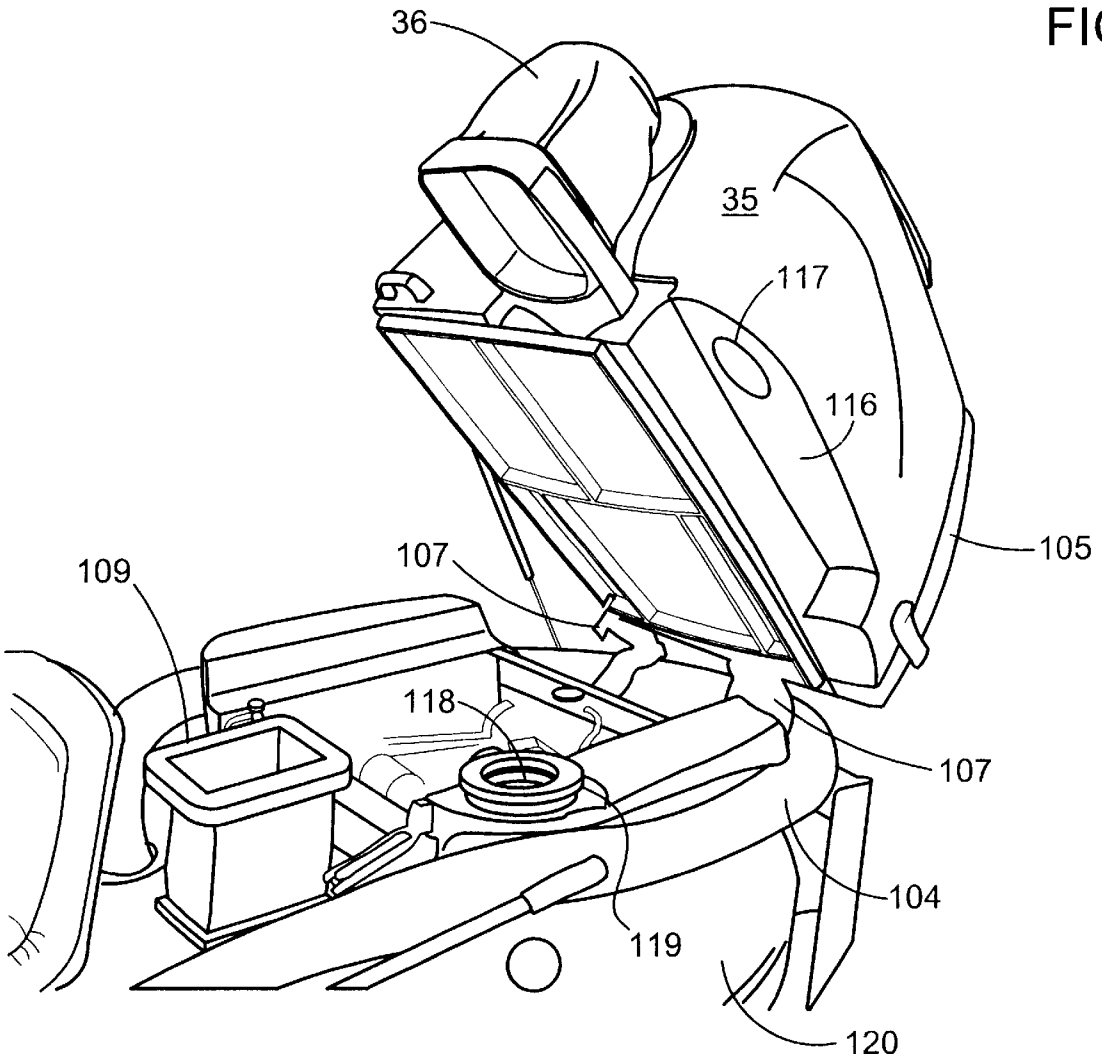
FIG. 18 is an upper left perspective view showing a portion of the machine and illustrating the hopper in the raised position.
Figure 19:
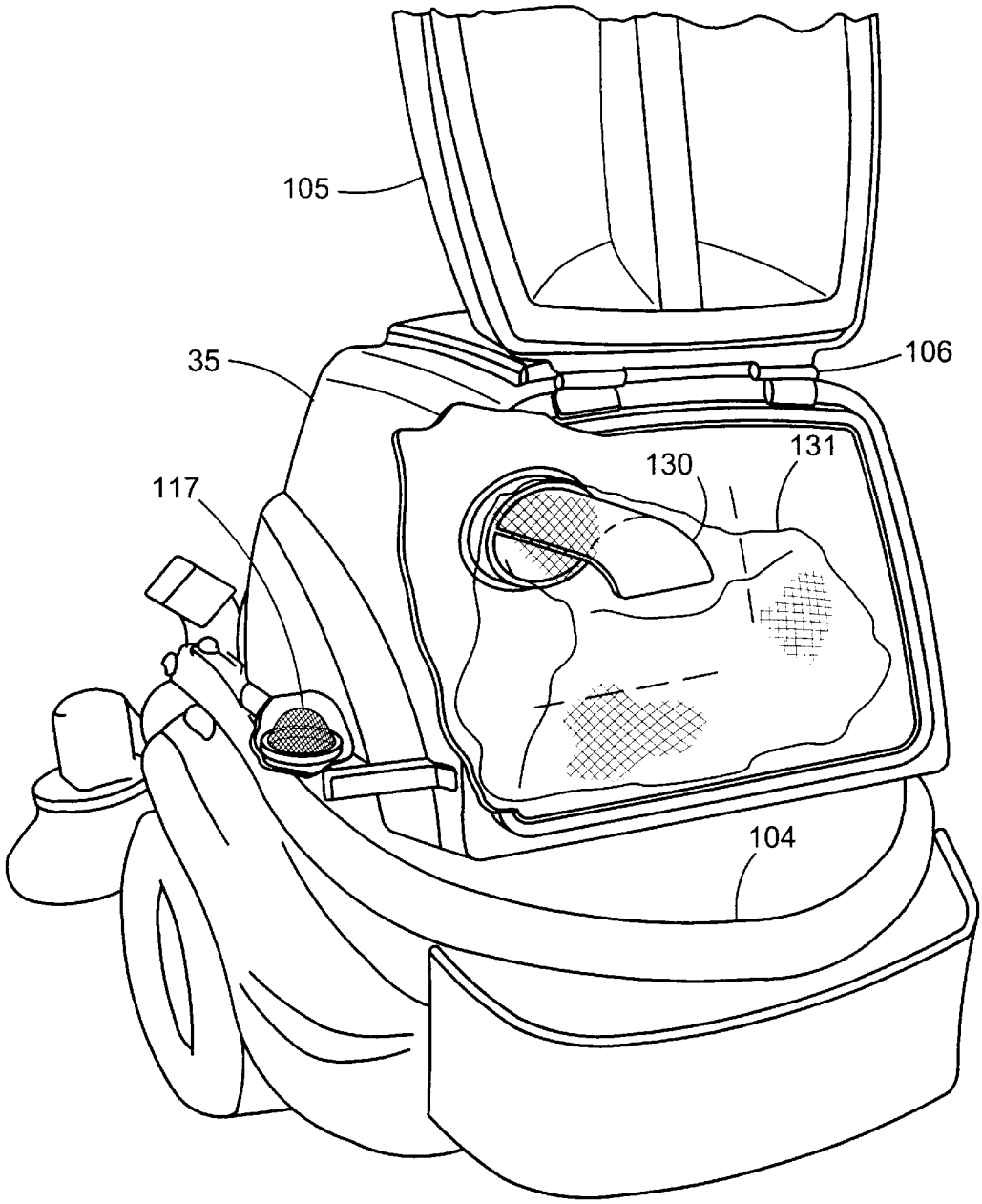
FIG. 19 is a perspective view taken from the rear, left side with a portion of the hopper broken away to illustrate the placement of the refuse bag within the hopper, with the hopper door raised.

The rear of the hopper 35 is provided with a door 105 which is hinged at 106 to swing upwardly (see FIG. 19). Moreover, as seen in FIG. 18, the rear of the hopper 35 is hingedly mounted by means of hinge members 107 to the rear of the machine for movement between the use position of FIG. 1 and the dumping position of FIG. 18. The outlet of the blower 97 is provided with a gasket 109 of flexible, sealing material, such as neoprene, so that when the hopper is lowered, the conduit 36 forms a seal with the outlet of the blower.

The hopper 35 includes a partial side wall on either side, the left side partial bottom wall being designated at 116 in FIG. 18. An outlet aperture 117 is provided in the bottom wall 116 which serves as a discharge aperture for air passing through the filter bag (as will be described) and being recirculated back to the vacuum shoe, as will now be described. The aperture 117 is aligned with a similar aperture 118 (FIGS. 17 and 18) which is provided with a sealing gasket 119. The aperture 118 is formed in a molded lateral housing section or "fender" generally designated 120. The fender 120 is a sealed shell except for the inlet opening 118 and a discharge opening designated 121 in FIG. 17.

The fender 120 includes a recess 123 for a battery, and it also includes a recess 124 for accommodating a fuel tank, and a clean out plug 126. Otherwise, as mentioned, the fender 120 acts as a conduit for the recirculating air as indicated by the arrows 125. As can be seen, the recirculating air from the hopper enters the opening 118, travels downwardly adjacent the recess 124 and thence beneath the battery recess 123 and thence upwardly and forwardly through a discharge conduit 127 and the discharge aperture 121 into the previously described conduit 31, the outlet end of which is connected to the recirculating air connector 30 on the top wall 38 of the vacuum shoe 27.

Figure 20:
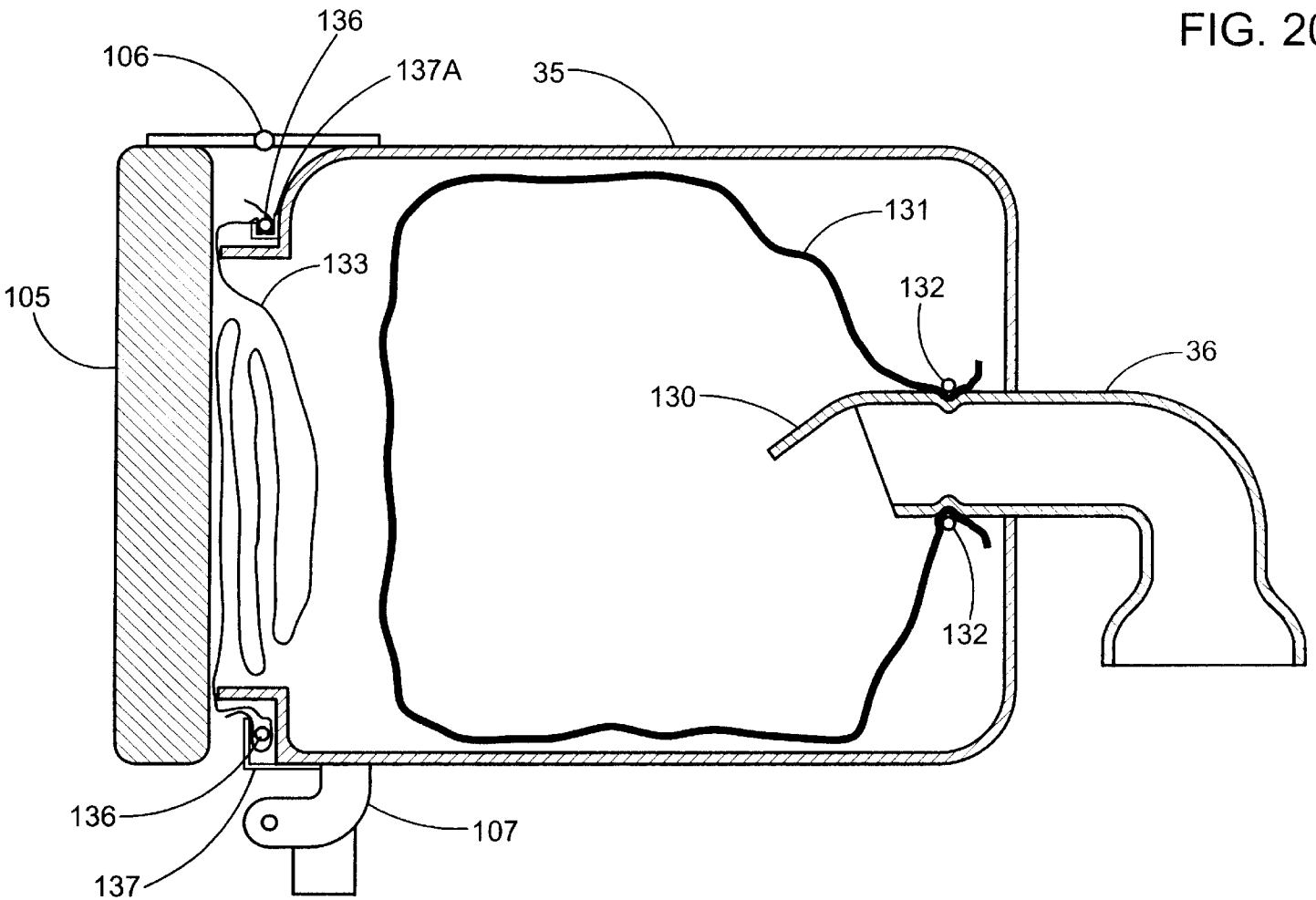
FIG. 20 is diagrammatic view illustrating a vertical cross sectional view looking toward the left of the machine, and taken through the center of the hopper, illustrating the location of a scrim bag and a plastic trash bag in the hopper, with the hopper in the use position.
Figure 21:
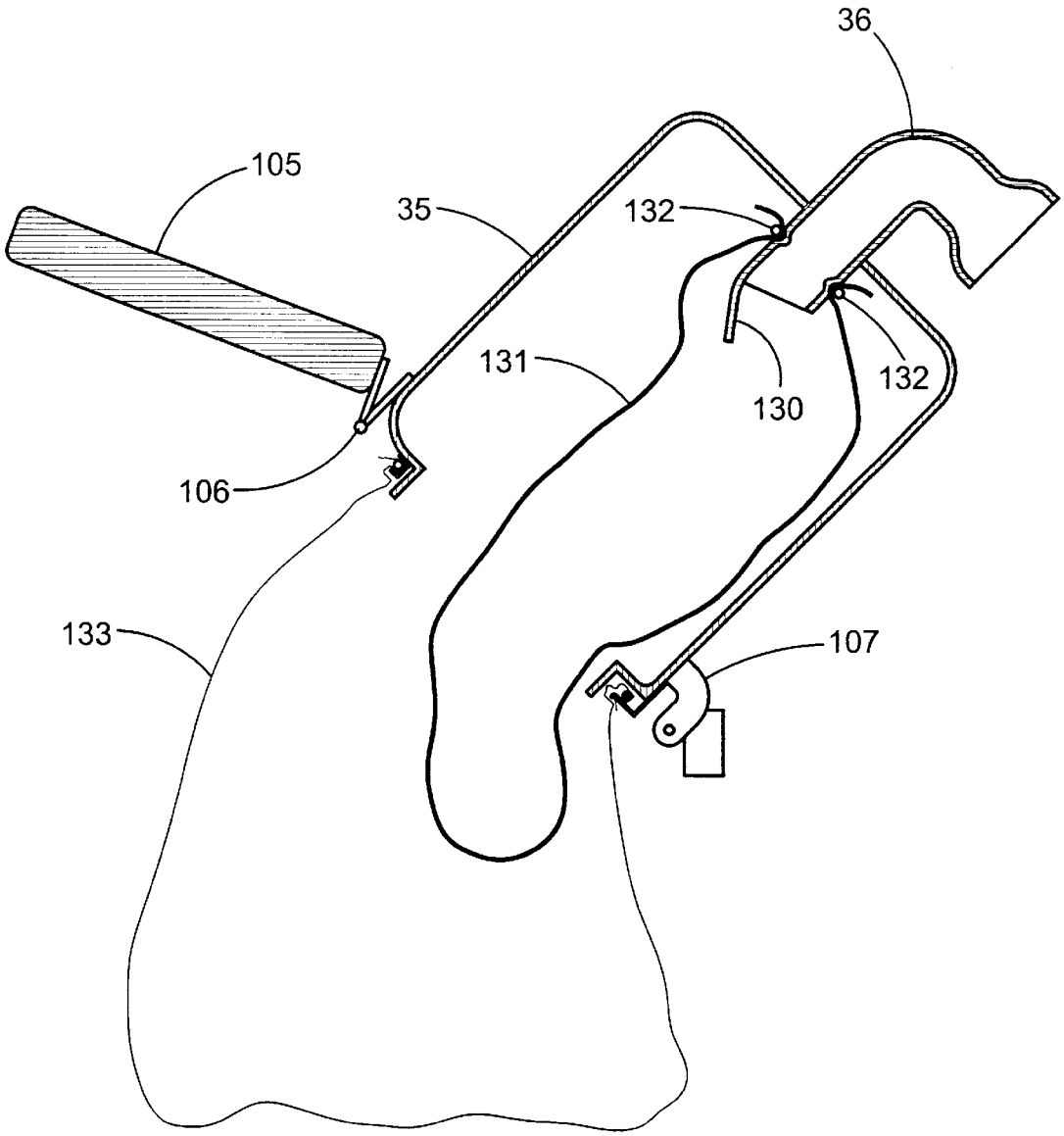
FIG. 21 is a view similar to FIG. 20, with the hopper raised to the dump position and the hopper door open, showing the dumping of the scrim bag into the poly bag for disposal.

Turning now to FIGS. 19–21, as best seen in FIGS. 20–21, the conduit 36 extending from the outlet of the blower to the front wall of the hopper 35 extends into the interior of the hopper, and the top portion is provided with a deflector 130. A first collection bag 131 has its opening mounted to the interior extension of the conduit 36, and it is secured by means of a stretched cord 132 or other elastic band to the extension of conduit 36.

The bag 131 may be a "scrim" bag, made of pressed polyethylene fibers so that it permits air to flow through it but traps larger particles and most debris. Air passing through the scrim bag 131 passes through a filter mounted in the top of the hopper 35 which filters out fine particles. Air which does not pass through the filter is routed through the outlet opening 117 (FIG. 18) and into the fender 120 for recirculation to the vacuum shoe as described above.

After a period of use, the outlet filter begins to clog as the fine materials collect on it. This increases the flow of recirculation air back to the vacuum shoe, and this acts as a pressure regulator, maintaining the collection efficiency of the system until the filter is changed. Obviously, the filter must ultimately be changed.

When it is desired to empty the scrim bag 131, the hopper door 105 is opened, and, if a trash bag is not used, the scrim bag may simply be pulled off the extension of conduit 36 and the stretched cord 132 remains on the bag, acting as a closure member. Alternately, the hopper 35 maybe tilted to the raised position seen in FIGS. 18, 21. The scrim bag 131 then falls off of its own weight onto the ground or, if a trash bag is used, into that bag which may then be removed from its holder and the scrim bag and its contents may be disposed of in the trash bag 133.

When the scrim bag 131 is used for collecting refuse, provision may be made for including an impermeable, conventional trash, lawn or leaf bag 133. The opening of the trash bag 133 is secured about the opening covered by the hopper door 105 by means of a wire hoop 136 which is inserted into the opening of bag 133 and is then releaseably fit into an angled holder members 137 and 137A as shown in FIG. 20.

As an alternative, the scrim bag may be replaced by a nylon mesh bag having a water-impermeable bottom.

Having thus disclosed in detail the illustrated embodiment, persons skilled in the art will be able to modify certain of the structure which has been described and to substitute equivalent elements for those disclosed; it is, therefore, intended that all such modifications and substitutions be covered as they are embraced within the spirit and scope of the appended claims.

We claim:

1. In a mobile vehicle adapted for cleaning a surface having a plurality of support wheels, the improvement comprising:

a frame;

first and second ground-engaging brushes driven in rotation about generally, upright axes and located respectively at a front left corner and a front right corner of said vehicle;

first and second articulated mechanisms carried by said frame for mounting said first and second ground engaging brushes adapted to engage the ground respectively for independent movement in response to contact with an object, each articulated mechanism comprising:

a first arm mounted for rotation about a first vertical axis from a position wherein an associated one of said first and second ground engaging brushes is located at a use position to a second position inboard of said use position; and a second arm pivotally carried by said first arm at a forward position thereof and mounted for rotation about a vertical axis from said use position in counter rotation to the rotation of said first arm, thereby to permit said associated brush to move laterally of said first arm in a direction counter to the direction of movement of said first arm when said first arm moves away from said use position, whereby when both of said first and second arms are actuated by engagement of the associated brush with an object, said associated brush moves both inwardly and rearwardly of said frame.

2. The vehicle of claim 1 further comprising:

a lift linkage mounted to said frame and supporting said first and second articulated mechanisms; and a first actuator carried by said frame and adapted to actuate said lift linkage under control of an operator selectively to raise and lower said first and second articulated arms.

3. The vehicle of claim 2 further comprising a vacuum shoe having an open front and bottom carried by said frame to the rear of said brushes to suction material from said surface, including material moved inwardly by said brushes; and at least one link connected at one end to said lift linkage and connected at another end to said vacuum shoe by means of a slot such that as said actuator lowers said brushes to said use position, said vacuum shoe is lowered to a working position relative to said surface, and said vacuum shoe is free to rise over an object on said surface.

4. The vehicle of claim 3 further comprising a support arm connected at one end to said vacuum shoe and pivotally connected at a distal end to said frame to support said vacuum shoe and to guide said vacuum shoe into parallel relation with said surface in use position.

5. The vehicle of claim 4 further comprising a second actuator controlled by an operator selectively to lift said vacuum shoe to a raised position above said surface while permitting said brushes to remain in their respective use positions.

6. The vehicle of claim 5 further comprising a blower:

a first conduit coupled between said vacuum shoe and said blower for evacuating air and material from said shoe;

a hopper carried by said frame and having an inlet receiving said air and material from said blower;

an air permeable bag in said hopper having an opening coupled to said inlet of said hopper to receive said air and material from said blower and filtering out and retaining said material;

a filter for fine particles mounted to said hopper to permit air to pass through said hopper while filtering finer particles therefrom; and a recirculating conduit for routing recirculating air from within said hopper to said vacuum shoe.

7. The vehicle of claim 6 wherein said air permeable bag comprises:

a spun synthetic fiber; said hopper further comprising:

a rear opening and a door hinged to close said rear opening, said hopper being pivotally mounted for rotation between a use position and a dumping position; said apparatus further comprising:

a mount extending adjacent said rear opening for receiving a wire frame to secure a trash bag about said rear opening;

whereby the contents of said air permeable bag may be transferred directly to said trash bag upon opening said door, securing said trash bag to said mount with said wire frame and unsecuring said air permeable bag and rotating said hopper to said dump position.

8. The vehicle of claim 6 wherein said bag comprises a nylon scrim bag having a water impermeable lower section adapted to rest on the bottom of said hopper, said hopper including a door which may be opened and said hopper tilted to a dump position to discard the contents of said bag under gravity.

9. The vehicle of claim 6 wherein said vehicle includes an outer casing and said recirculating conduit includes a section passing through a hollow cavity in said casing, said cavity acting as a plenum for catching heavier debris in the recirculated air; and further comprising a plug removably coupled to a lower wall of said cavity for any debris trapped therein under gravity.

10. The vehicle of claim 3 further comprising a latch for each of said articulated arms, each latch securing an associated articulated arm in a raised position while permitting said actuator to lower said vacuum shoe to the use position.

11. The vehicle of claim 3 further comprising:

a flap pivotally mounted to said vacuum shoe and sized and arranged to substantially close said open front thereof; and a third actuator, controlled by a user, for rotating said flap on the go to adjust the size of said inlet opening for said vacuum shoe, the size of said inlet opening adjusting the velocity of air into said vacuum shoe through said inlet opening.

12. The vehicle of claim 11 further comprising a rubber edging strip attached to a lower edge of said flap.

13. The vehicle of claim 3 further comprising first and second latches for selectively coupling said first and second articulating mechanisms to said frame whereby when said first actuator is actuated to lower said lift linkage, said vacuum shoe will be lowered but said first and second brushes will remain in a raised position.

14. The vehicle of claim 1 further comprising, for each of said articulated mechanisms:

a first spring biasing said associated first arm outwardly to a use position while permitting said first arm to pivot inwardly toward the center of said vehicle; and a second spring interconnected between said first and second arms to bias said associated second arm to a use position while permitting said associated second arm to rotate in a direction counter to the rotational direction taken by said associated first arm in moving away from the use position thereof in response to engagement with an object.

15.The vehicle of claim 1 wherein said first arm of each of said first and second articulated mechanisms extends fore-to-aft of said vehicle in the use position;

said vehicle, further comprising:

a first spring biasing an associated first arm to rotate outwardly of a center of said vehicle; and a stop for limiting the outboard rotation of said associated first arm.

16. The vehicle of claim 15 wherein said second arm of each of said first and second articulated mechanisms supports its associated brush such that the axis of rotation of said associated brush lies outboard of an extension of its associated first arm in the direction of travel, thereby permitting said brush to move laterally outwardly of said associated first arm and simultaneously rearwardly about the pivotal convection between said first and second arms when said brush encounters an obstruction.

* * * * *